US006610939B2

(12) United States Patent
Watada

(10) Patent No.: US 6,610,939 B2
(45) Date of Patent: Aug. 26, 2003

(54) SWITCH

(75) Inventor: Tsutomu Watada, Tokyo (JP)

(73) Assignee: Niles Parts Co., Ltd. (JP)

( * ) Notice: Subject to any disclaimer, the term of this patent is extended or adjusted under 35 U.S.C. 154(b) by 0 days.

(21) Appl. No.: 10/092,515

(22) Filed: Mar. 8, 2002

(65) Prior Publication Data

US 2002/0125114 A1 Sep. 12, 2002

(30) Foreign Application Priority Data

Mar. 12, 2001 (JP) ..... P2001-069481

(51) Int. Cl.[7] ..... H01H 15/00
(52) U.S. Cl. ..... 200/16 D; 200/16 C
(58) Field of Search ..... 200/16 R–16 C, 200/252, 253, 547, 550, 551, 16 A

(56) References Cited

U.S. PATENT DOCUMENTS

| | | | | |
|---|---|---|---|---|
| 3,255,319 A | | 6/1966 | Paine | |
| 3,531,799 A | * | 9/1970 | Rendler | 341/16 |
| 3,544,740 A | * | 12/1970 | Robin | 200/16 D |
| 3,694,590 A | | 9/1972 | Otterlei | 200/16 |
| 4,012,608 A | * | 3/1977 | Lockard | 200/16 D |
| 5,544,274 A | * | 8/1996 | Walker et al. | 388/838 |

FOREIGN PATENT DOCUMENTS

| | | |
|---|---|---|
| DE | 3037676 A1 | 5/1982 |
| FR | 1 557 136 | 2/1969 |
| FR | 2 335 932 | 7/1977 |
| GB | 1 245 075 A1 | 9/1971 |
| GB | 2 257 831 A1 | 1/1993 |
| JP | 08-304063 A1 | 5/1998 |
| JP | 10-134672 | 5/1998 |

* cited by examiner

*Primary Examiner*—Elvin Enad
*Assistant Examiner*—Lisa Klaus
(74) *Attorney, Agent, or Firm*—Rader, Fishman & Grauer PLLC

(57) ABSTRACT

To make it possible to provide a switch which can adjust ON/OFF switching positions easily and which can suppress wear to enhance the durability, there is provided an inhibitor switch for detecting the shift position of an automatic transmission. From a pole board, there are protruded insulator portions of an insulator having sliding faces on their surfaces. Sliding faces are provided with recesses for reducing facial pressures. When a moving contact slides with respect to a stationary contact to ON/OFF switching positions, the moving contact starts to ride on the insulator portions so that the moving contact goes out of contact with the stationary contact and can move from the sliding faces into the recesses. When the moving contact goes down the insulator portions, the moving contact contacts with the ON/OFF switching positions of the stationary contact.

5 Claims, 14 Drawing Sheets

Fig.8

| | VB | S1 | S2 | S3 | S4 |
|---|---|---|---|---|---|
| P-ST | ○ | | | | |
| P | ○ | | | ○ | |
| P-R | ○ | | | ○ | ○ |
| R | ○ | ○ | | ○ | ○ |
| N-R | ○ | ○ | | ○ | |
| N-ST | ○ | ○ | | | |
| N-D | ○ | ○ | | | ○ |
| D | ○ | ○ | ○ | | ○ |
| 3 | ○ | | ○ | | ○ |
| 2 | ○ | | ○ | ○ | ○ |
| 1 | ○ | | ○ | ○ | |

(a)

(b)

(a)

(b)

SWITCH

BACKGROUND OF THE INVENTION

1. Field of the Invention

The present invention relates to a switch such as an inhibitor switch.

2. Description of the Related Art

An inhibitor switch device of this kind of the related art is exemplified in Unexamined Published Japanese Patent Application No. 10-134672, as show in FIG. 11. This inhibitor switch 201 is provided with a plurality of stationary contacts 205 on the lower face of a pole board 203, and a moving contact 209 is supported on a moving board 207 which can move with respect to the pole board 203. The moving contact 209 is provided with a plurality of contact arms 211 in a cantilever shape. Each contact arm 211 slidably contacts with each stationary contact 205 as shown in FIG. 12 by way of example.

Each stationary contact 205 is insert-molded on the pole board 203 made of a resin, and a curved contact portion 213 of the contact arm 211 can slide with respect to the stationary contact 205. Moreover, an ON/OFF switching position 215 by the slide of the moving contact 211 with respect to the stationary contact 205 provides a boundary of the insert molding between the stationary contact 205 and the pole board 203.

In accordance with the movement of the moving board 207, therefore, each contact arm 211 slides in contact with each stationary contact 205 so that the contact/non-contact of the contact arm 211 with respect to the stationary contact 205 are made through the ON/OFF switching position 215 so that the selected ON of each stationary contact 205 can be retained.

In this case, the contact portion 213 of the contact arm 211 is curved to take a substantially linear contacting state with the stationary contact 205. By setting the boundary of the insert molding accurately to decide the ON/OFF switching position 215, therefore, the contact/non-contact of each contact arm 211 with respect to each stationary contact 205 can be accurately switched.

However, there is a problem that it is seriously difficult to adjust the ON/OFF switching position 215 on a mold. In the structure thus far described, more specifically, when the ON/OFF switching position 215 is to be adjusted, it is necessary to scrape the end edge of the stationary contact 205, for example, by 1/100 mm and to adjust the insert mold accordingly. This makes it necessary to change both the molds for the pole board 203 and the stationary contacts 205 and makes it seriously difficult to decide the ON/OFF switching position 215 by adjusting the two molds.

At a press molding time of the stationary contacts 205, on the other hand, there are formed sags 219, as shown in FIG. 13A, or burrs 221, as shown in FIG. 13B. Even if the ON/OFF switching position 215 is decided, actual ON/OFF switching positions 223 and 225 are dislocated from the ON/OFF switching position 215 by the sags 219 or the burrs 221. From this point, there arises a problem that it is seriously difficult to adjust the ON/OFF switching position accurately.

On the other hand, there is another switch, as exemplified in Unexamined Published Japanese Utility Model Application No. 61-151214 and shown in FIG. 14 and FIG. 15. This switch 231 is used for the door of a refrigerator, for example. This switch 231 is equipped with an operating knob 233.

This operating knob 233 is biased outward by an internal spring. This operating knob 233 is equipped with an associated slide. On this slide, there is retained a moving contact 235. This moving contact 235 provides a contact portion 237 at its leading end. In the switch 231, on the other hand, a pole board 239 is equipped with a stationary contact 241. From the pole board 239, there is protruded an insulator portion 243.

When the operating knob 233 is depressed, therefore, the moving contact 235 slides with the slide so that the contact portion 237 comes into contact with the stationary contact 241, as shown by single-dotted lines, to turn ON the switch. When the depression of the operating knob 233 is released, the moving contact 235 is returned to its original position by the biasing action of the return spring. At this time, the moving contact 235 rides on the insulator portion 243, as shown by solid lines, so that the contact portion 237 of the moving contact 235 floats from the stationary contact 241.

By thus causing the moving contact 235 to float thereby to turn OFF it with respect to the stationary contact 241, the ON/OFF switching position can be set not at the end edge of the stationary contact 241 but over the intermediate portion of the stationary contact 241 to switch ON/OFF relatively accurately.

If the floating structure of the contract portion 237 is merely applied to the inhibitor switch 201, however, there is invited a new problem. In the case of the switch 231 for the door of the refrigerator, more specifically, the moving contact 235 can be stopped at the position shown by the solid lines in FIG. 14. In the case of the inhibitor switch 201, however, there are many portions in which the stationary contacts are arranged on the two sides of the insulator portion 243, and there are repeated operations in which the moving contact 235 rides on the insulator portion 243 and in which its contact portion 237 slides over the insulator portion 243 and again contacts with the next stationary contact. As a result, the contact portion 237 of the moving contact 235 may slide on the protruded insulator portion 253 while receiving a high facial pressure (or a contact pressure) to proceed the wear early. This is especially true when the inhibitor switch is frequently mounted in the mission case of automatic transmission or in a case outside of the mission case. From the aspect of heat resistance and strength, therefore, the pole board may be made of a resin containing glass fibers, and the wear of the contact portion 237 of the moving contact 235

In FIG. 16, the pole board 203 of the inhibitor switch is provided with a contact riding insulator portion 245. The inhibitor switch can be turned ON/OFF irrespective of the end edge position of the stationary contact 205 by the ride on the insulator portion 245, as shown in FIG. 16A. As a wear 213*a* proceeds on the contact portion 213, as shown in FIG. 16B, however, the mechanical position of the moving contact 235 is shifted, when the moving contact 235 abuts against and rides on the insulator portion 245, leftward of the Drawing to an extent of the extension from a distance L1 before the wear of FIG. 16A to a distance L2 after the wear. As a result, the mechanical position of the moving contact 235 and the contact switching position (i.e., the ON/OFF switching position) are dislocated according to the difference between the distances L1 and L2, i.e., the extension of the wear, and the inhibitor switch may lose durability. On the other hand, large amounts of abrasion powder, as produced in the insulator portion 245, migrate together with the moving contact 209 to cover the stationary contact 205. A contact failure may be caused if the abrasion powder is sandwiched between the stationary contact 205 and the moving contact 209 brought down onto the former.

An object of the present invention is to provide a switch device which can adjust the ON/OFF switching position easily and which can effect an accurate ON/OFF switching and retain durability while suppressing the wear of a moving contact.

According to a first aspect of the invention, there is provided a switch having a moving contact made slidable with respect to stationary contacts mounted on a pole board, wherein the pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts; the insulator portions are provided in their sliding faces with recesses which correspond to the OFF positions of the moving contact for reducing facial pressures; and when the moving contact slides with respect to the stationary contacts to the ON/OFF switching positions of the stationary contacts, the moving contact starts to ride on the sliding faces of the insulator portions so that the moving contact goes out of contact with the stationary contacts and can move from the sliding faces into the recesses, and when the moving contact goes down the sliding faces of the insulator portions, the moving contact contacts with the ON/OFF switching positions of the stationary contact.

According to a second aspect of the invention, there is provided a switch comprising a pole board having stationary contacts; and a moving board including a moving contact made slidable to the stationary contacts and made movable with respect to the pole board, whereby the switch detects the shift position of an automatic transmission with the moving contact and the stationary contacts, wherein the pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts; the insulator portions are provided in their sliding faces with recesses which correspond to the OFF positions of the moving contact for reducing facial pressures; and when the moving contact slides with respect to the stationary contacts to the ON/OFF switching positions of the stationary contacts, the moving contact starts to ride on the sliding faces of the insulator portions so that the moving contact goes out of contact with the stationary contacts and can move from the sliding faces into the recesses, and when the moving contact goes down the sliding faces of the insulator portions, the moving contact contacts with the ON/OFF switching positions of the stationary contact.

In a switch as set forth in the first or second aspect of the invention, according to a third aspect of the invention, the recesses have a depth set equal to or more than the distance between the sliding faces of the insulator portions and the surfaces of the stationary contacts.

In a switch as set forth in the first or second aspect of the invention, according to a fourth aspect of the invention, the moving contact is provided with a contact portion for contacting with the stationary contacts and a riding portion capable of riding on the insulator portions; and when the contact portion slides with respect to the stationary contacts to the ON/OFF switching positions of the stationary contacts, the riding portion starts to ride on the sliding faces of the insulator portions so that the contact portion goes out of contact with the stationary contacts and so that the riding portion can move from the sliding faces into the recesses, and when the riding portion goes down the sliding faces of the insulator portions, the contact portion contacts with the ON/OFF switching positions of the stationary contact.

In a switch as set forth in the fourth aspect of the invention, according to a fifth aspect of the invention, the recess has a depth smaller than the distance, as formed when the riding portion rides on the sliding faces of the insulator portions, between the contact portion and the stationary contacts.

According to the first aspect of the invention, there is provided a switch having a moving contact made slidable with respect to stationary contacts mounted on a pole board, and the pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts. When the moving contact slides with respect to the stationary contacts to the ON/OFF switching positions of the stationary contacts, therefore, the moving contact starts to ride on the sliding faces of the insulator portions so that the moving contact goes out of contact with the stationary contacts. When the moving contact goes down the sliding faces of the insulator portions, the moving contact can contact with the ON/OFF switching positions of the stationary contact.

When the riding portion of the moving contact rides on the insulator portion or goes down the insulator portion irrespective of the position of the end edge of the stationary contact, therefore, the moving contact can be reliably into contact/non-contact at the ON/OFF switching position over the stationary contacts. As a result, it is possible to detect the shift position accurately.

Moreover, the insulator portions are provided in their sliding faces with recesses which correspond to the OFF positions of the moving contact for reducing facial pressures. Therefore, the moving contact can move from the sliding faces into the recesses to lower the facial pressure of the moving contact drastically in the OFF state. Even when the moving contact slides in the OFF state, therefore, it can slide in the state of a low facial pressure in the recesses to suppress the wear of the moving contact drastically. As a result, the mechanical position of the moving contact and the contact switching position can be kept long in the initial setting without being offset, to improve the durability of the switch drastically.

Moreover, the wear reduction at the insulator portion can suppress production of the abrasion powder so that the abrasion powder of the insulator does not move or hardly moves together with the moving contact onto the station contacts when the moving contact goes down onto the stationary contacts, thereby preventing contact failure when the moving contact is brought down onto the stationary contacts.

According to the second aspect of the invention, a switch comprises a pole board having stationary contacts; and a moving board including a moving contact made slidable to the stationary contacts and made movable with respect to the pole board, whereby the switch detects the shift position of an automatic transmission with the moving contact and the stationary contacts. The pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts, and the insulator portions are provided in their sliding faces with recesses which correspond to the OFF positions of the moving contact for reducing facial pressures. Therefore, effects similar to those of Claim 1 can be attained in the switch for detecting the shift position of the automatic transmission.

In addition to the effects of the first or second aspect of the invention, according to the third aspect of the invention, the recesses have a depth set equal to or more than the distance between the sliding faces of the insulator portions and the surfaces of the stationary contacts. Therefore, the facial pressure of the moving contact can be reliably lightened.

In addition to the effects of the first or second aspect of the invention, according to the fourth aspect of the invention, the moving contact is provided with a contact portion for contacting with the stationary contacts and a riding portion capable of riding on the insulator portions. Therefore, the slides of both the contact portion and the riding portion can be shared between the stationary contact and the insulator portions so that their wears can be more lightened.

In addition to the effects of the fourth aspect of the invention, according to the fifth aspect of the invention, the recess has a depth smaller than the distance, as formed when the riding portion rides on the sliding faces of the insulator portions, between the moving contact and the stationary contacts. When the riding portion rides on the sliding faces of the insulator portions, therefore, the facial pressure of the contact portion of the moving contact can be reduced to zero thereby to lighten the wear more.

BRIEF DESCRIPTION OF THE DRAWINGS

FIG. 7 shows the periphery of the insulator portion according to the first embodiment, wherein FIG. 7A is an enlarged sectional view of the case of a shallow recess, and FIG. 7B is an enlarged sectional view of the case of a deep recess;

FIG. 8 is a diagram showing relations between the ON of the stationary contacts and the shift positions according to the first embodiment;

FIG. 13 shows the related art example, wherein FIG. 13A is a sectional view showing dislocations of the ON/OFF switching positions of a stationary contact due to sags, and FIG. 13B is a sectional view showing dislocations of the ON/OFF switching positions of the stationary contact due to burrs;

FIG. 16 shows an example in which a pole board is provided with an insulator portion, wherein FIG. 16A shows a state before a contact portion wears out, and FIG. 16B shows a state after the same wore out.

DESCRIPTION OF THE PREFERRED EMBODIMENTS

First Embodiment

Figure 1:
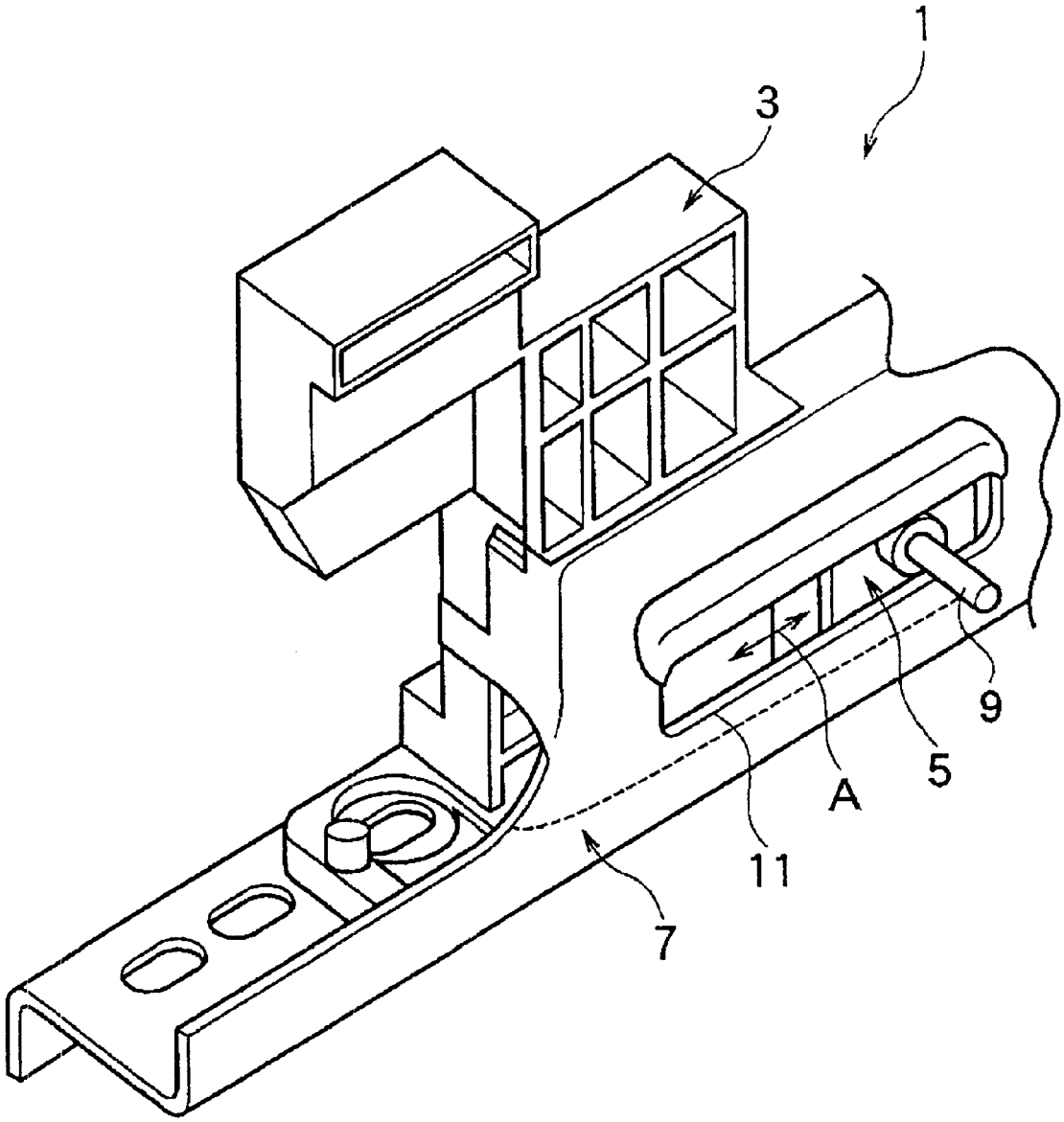
FIG. 1 is a perspective view of an inhibitor switch according to a first embodiment of the present invention.

FIG. 1 is a perspective view of an inhibitor switch as a switch, to which a first embodiment of the present invention is applied. This inhibitor switch 1 is arranged and mounted in an upright position, as shown in FIG. 1, in the mission case of an automatic transmission, although not shown. Moreover, the inhibitor switch 1 is splashed with hot oil in the mission case. This inhibitor switch 1 is substantially constructed to include a pole board 3, a moving board 5 and a metallic case 7 integrated with a bracket.

The pole board 3 is fixed in the case 7 by additionally fastening it, and the moving board 5 is so arranged between the case 7 and the pole board 3 that it can move reciprocally in the directions of arrows A with respect to the pole board 3.

From the moving board 5, there is protruded a drive pin 9. This drive pin 9 is protruded to the outside of the case 7 from a slot 11 which is elongated in the directions of arrows A in the case 7. The drive pin 9 is connected, although not shown, to the interlocking portion of the manual valve of the automatic transmission. Therefore, the shift position by the manual valve can be detected, when the moving board 5 moves with respect to the pole board 3 in the directions of arrows A in accordance with the shift position of the manual valve and stops.

Figure 2:
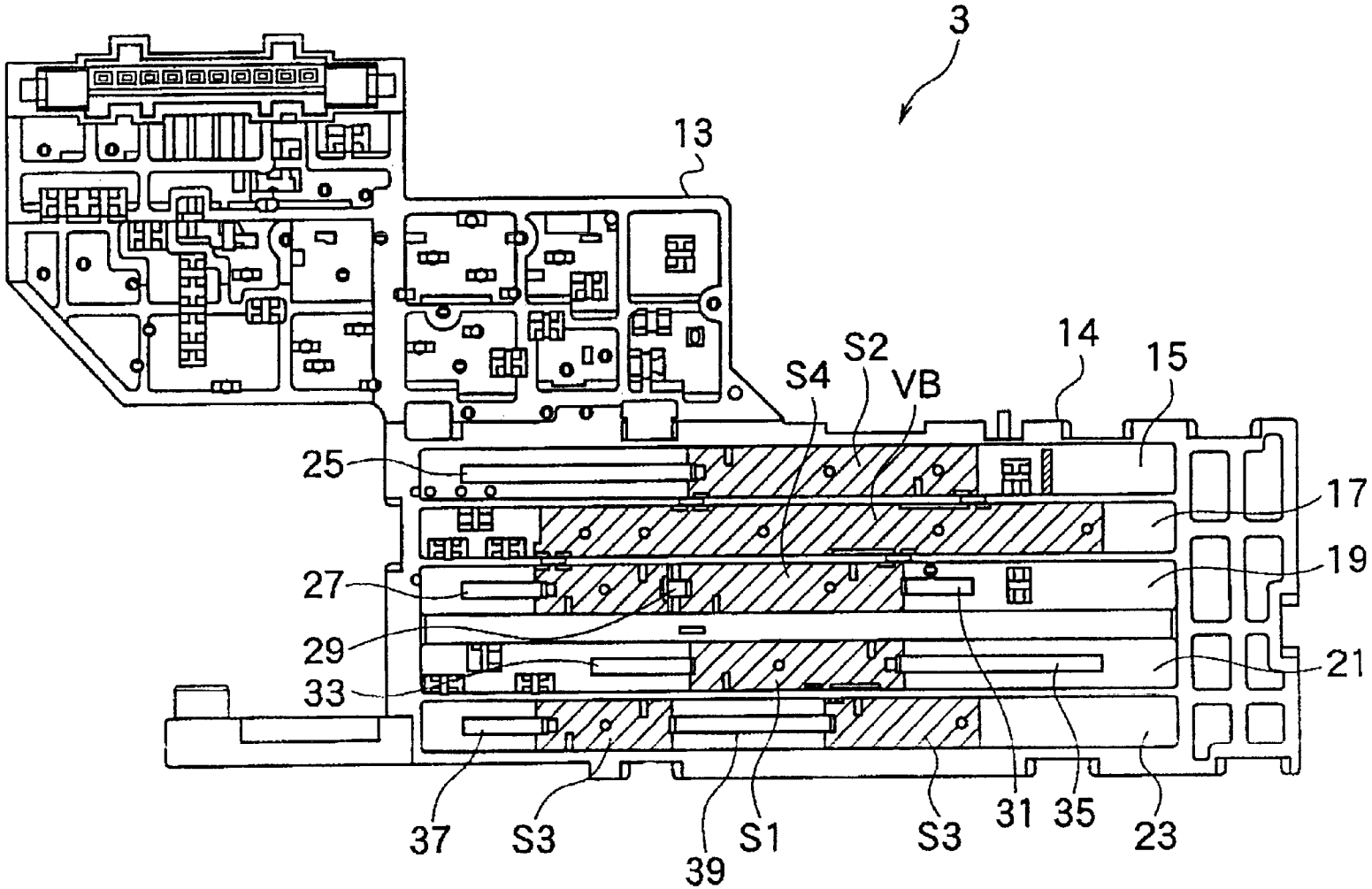
FIG. 2 is a front elevation of a pole board according to the first embodiment.

The pole board 3 has a contact structure, as shown in FIG. 2. FIG. 2 is a front elevation of the pole board 3. The pole board 3 has a substrate 13 molded of a resin, and the substrate 13 is provided with a plurality of stationary contacts S2, VB, S4, S1 and S3 on a vertical wall 14 confronting the case 7. Specifically, the vertical wall 14 of the substrate 13 is provided with five grooves 15, 17, 19, 21 and 23 in the directions of arrows A (FIG. 1). The individual grooves 15, 17, 19, 21 and 23 are recessed normal to the sheet of FIG. 2, and the stationary contacts S2, VB, S4, S1 and S3 of flat plate shapes are fixed on the deep faces of the grooves 15, 17, 19, 21 and 23, respectively.

The stationary contact VB is formed so long along the groove 17 that it may be a common contact for a normal ON state. The remaining stationary contacts S2, S4, S1 and S3 are individually set to predetermined lengths for ON/OFF connections.

The substrate 13 is provided with insulator portions 25, 27, 29, 31, 33, 35, 37 and 39 individually in the grooves 15, 17, 19, 21 and 23. These insulator portions 25, 27, 29, 31, 33, 35, 37 and 39 are made of insulators to correspond to the ON/OFF switching positions for providing contact/non-contact boundaries of the later-described moving contact with the stationary contacts S2, S4, S1 and S3. In the present embodiment, the insulator portions are integrally protruded from the deep face of the individual grooves 15, 17, 19, 21 and 23. However, separate insulator portions can be fixed by adhering them.

Figure 3:
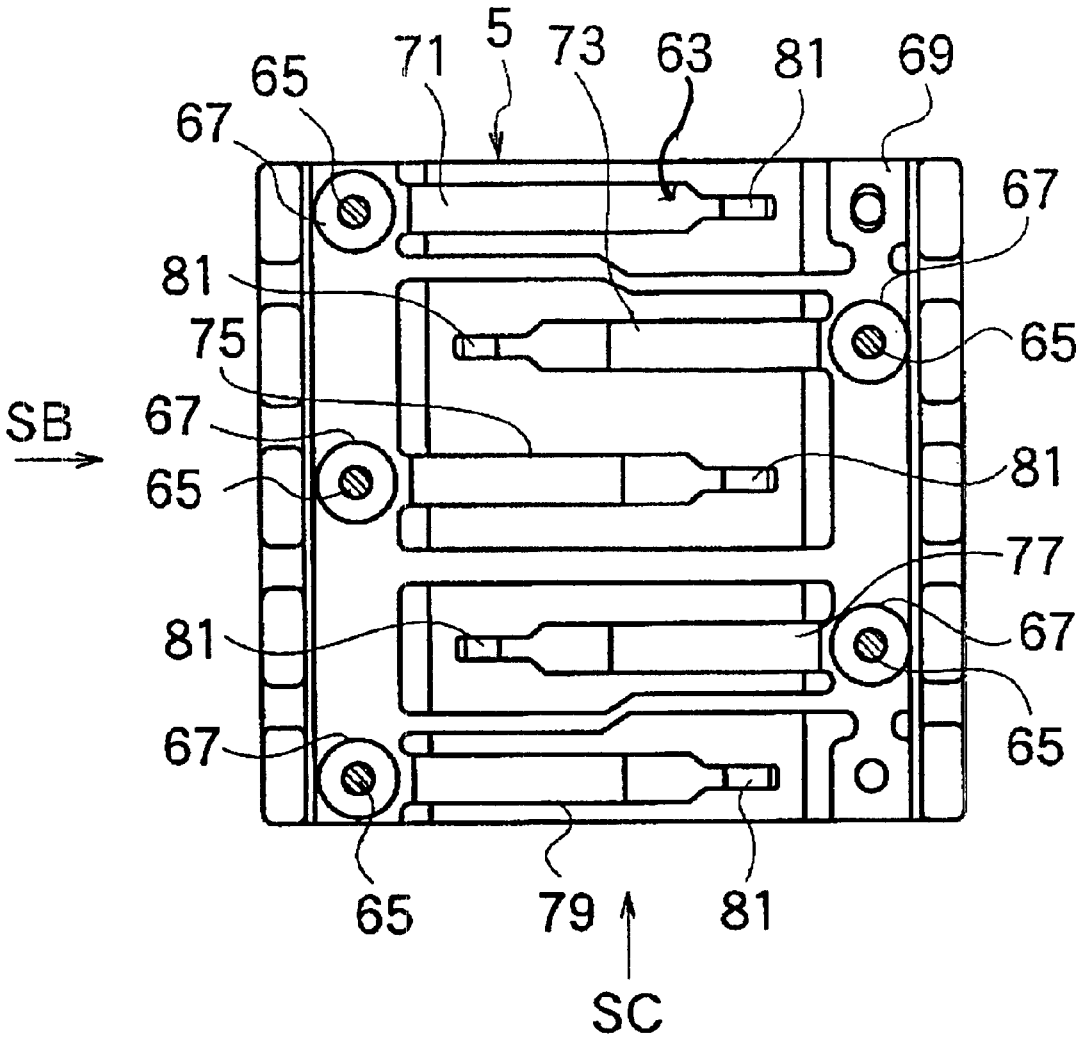
FIG. 3 is a front elevation of a moving board according to the first embodiment.
Figure 4:
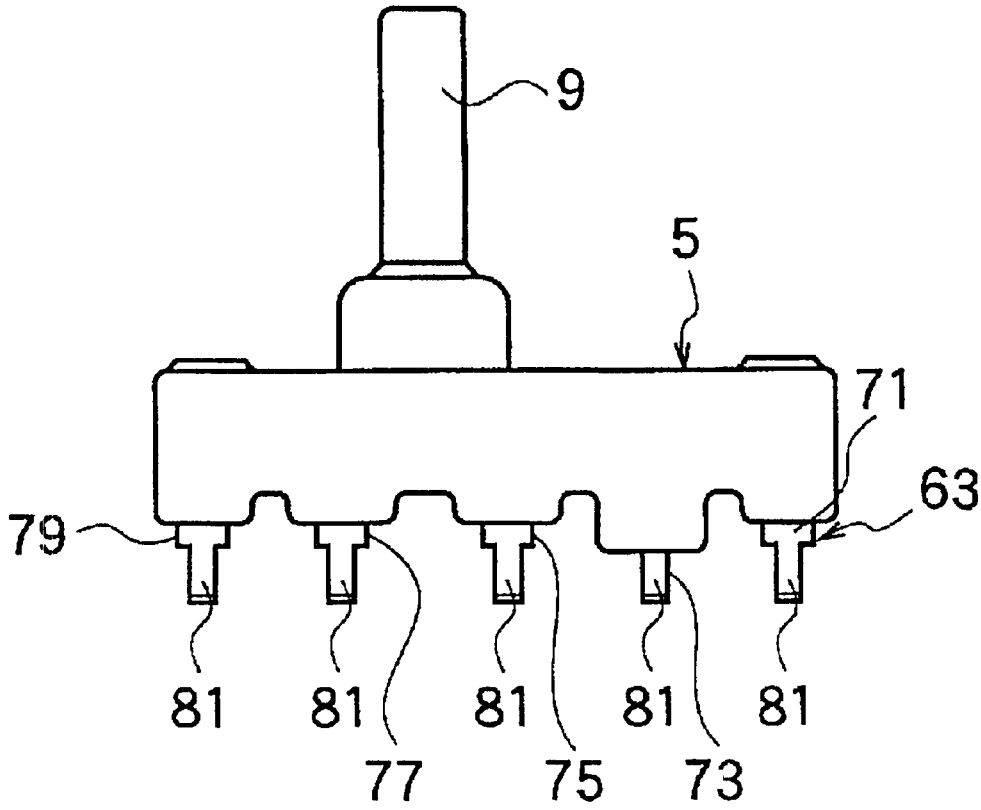
FIG. 4 is a side elevation of the moving board, as taken in the direction SB of FIG. 3, according to the first embodiment.

The moving board 5 is shown in FIG. 3 and FIG. 4. FIG. 3 is a front elevation of the moving board 5, and FIG. 4 is a side elevation taken in the direction of arrow SB of FIG. 3. Specifically, the moving board 5 is formed of a resin, and a moving contact 63 of a metal such as stainless steel is fixed on the face of that side of the moving board 5 that confronts the pole board 3. The moving contact 63 is fixed, for example, by additionally fastening fixtures 67 on joint pins 65 which are protruded from the moving board 5.

Figure 5:
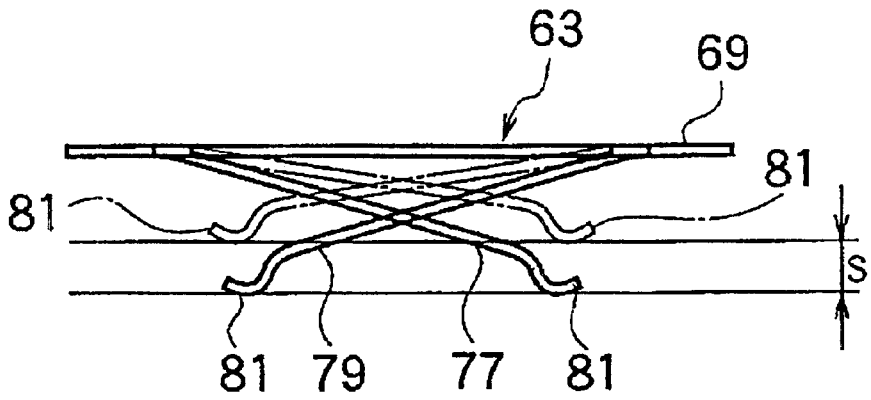
FIG. 5 is a side elevation of moving contacts, as taken in the direction SC of FIG. 3, according to the first embodiment.

FIG. 5 is a side elevation of the moving contact 63, as taken in a direction SC of FIG. 3. With reference to FIG. 5, the moving contact 63 has contact arms 71, 73, 75, 77 and 79 mounted in a cantilever shape on a frame-shaped fixing portion 69. Moreover, the leading ends of the contact arms 71, 75 and 79 and the contact arms 73 and 77 are arranged not on a common straight line but in the so-called "W-shape".

The individual contact arms 71, 73, 75, 77 and 79 are arranged at inclinations to have individual contact portions 81 in a cantilever shape at their leading ends. The individual contact portions 81 are curved. The individual contact portions 81 of the contact arms 71, 73, 75, 77 and 79 can abut against the stationary contacts S2, VB, S4, S1 and S3 of FIG. 2, respectively, and the contact arms 71, 73, 75, 77 and 79 are warped by S from their free states, as shown in FIG. 5, to come into elastic contact with the sides of the stationary contacts S2, VB, S4, S1 and S3 thereby to keep a constant contact pressure.

Here will be described in more detail the relations among the moving contact, the stationary contacts and the insulator portions, which construct the essential portion of the present embodiment of the invention.

The relations among the moving contact 63, the stationary contacts S2, S4, S1 and S3 and the insulator portions 25, 27, 29, 31, 33, 35, 37 and 39 are substantially identical at the individual stationary contacts S2, S4, S1 and S3. Therefore, the portion of the stationary contacts S3 will be extracted to be described, as shown in FIG. 6, while omitting the descriptions of the remaining relations among the other stationary contacts S2, S4 and S1, the moving contact 63 and the insulator portions 25, 27, 29, 31, 33 and 35.

Figure 6:
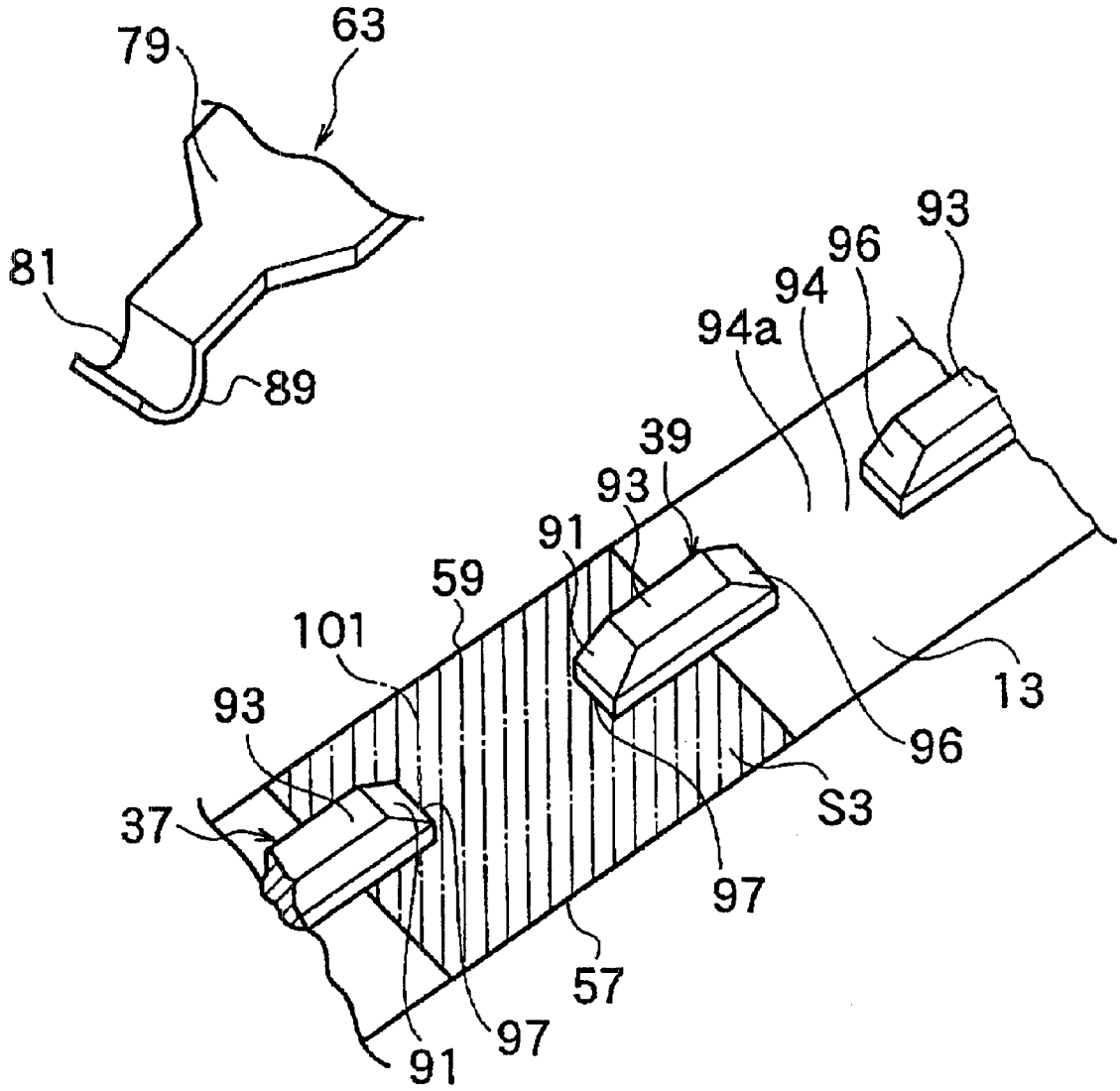
FIG. 6 is a perspective view in an exploded state showing relations among a contact arm, a stationary contact and an insulator portion according to the first embodiment.
Figure 7:
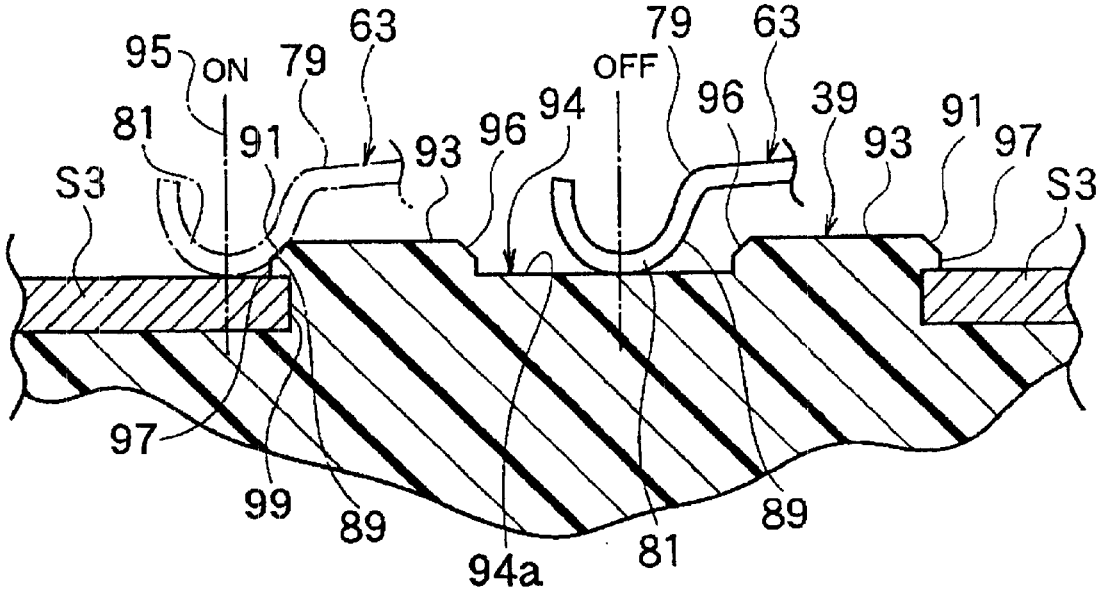
Figure 7:
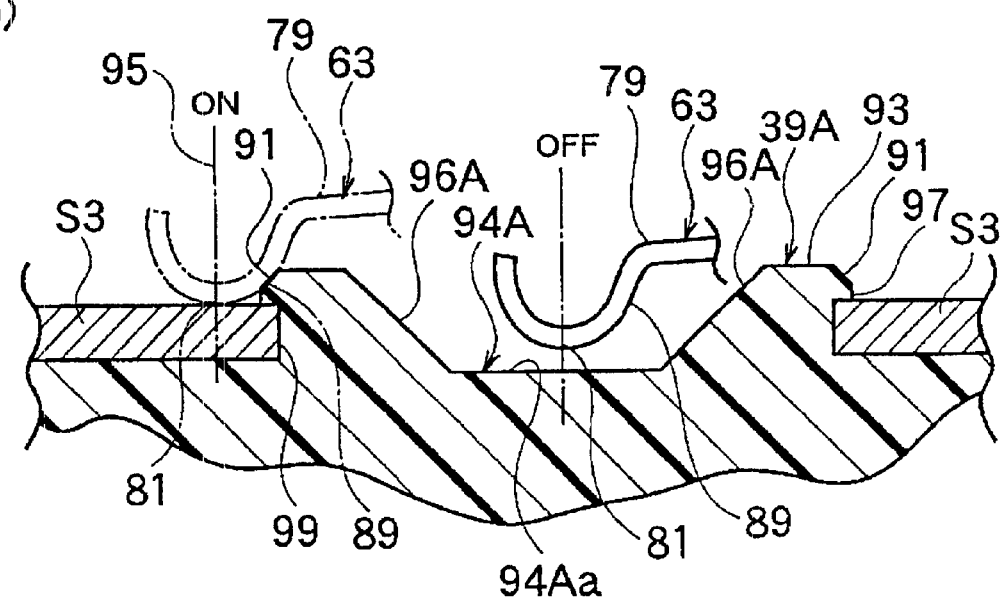

FIG. 6 is an exploded perspective view showing the relations among the stationary contacts S3, the insulator portions 37 and 39 and the contact arm 79 of the moving contact 63. In the state of FIG. 6, a sectional view at a portion of the stationary contacts S3 and the insulator portion 39 is shown in FIG. 7. FIG. 7A is a sectional view showing an example of a shallow recess, and FIG. 7B is a sectional view showing an example of a deep recess.

As shown in FIG. 6 and FIG. 7A, the contact portion 81 of the moving contact 63 is provided with a riding and sliding rounded face 89 by curving it as described before. On the other hand, the insulator portion 39 is provided with sliding faces 91 and 93 for guiding the rounded face 89 of the contact portion 81 to ride and slide thereon. The sliding faces 91 are formed to have a constant inclination, and the sliding faces 93 are set generally parallel to the sliding directions of the contact arm 79 of the moving contact 63. The height of the sliding faces 93 from the stationary contacts S3 may be as small as possible, considering the facial pressure of the moving contact 63.

The sliding faces 93 are provided with a facial pressure reducing recess 94 corresponding to the OFF position of the moving contact 63. In the present embodiment, the recess 94 has a depth set equal to the distance between the sliding faces 39 and the surfaces of the stationary contacts S3. As a result, the recess 94 has a bottom portion 94*a* flush with the surfaces of the substrate 13 and the stationary contacts S3. This recess 94 is provided for reducing the facial pressure of the moving contact 63, as described hereinbefore, and may be set as long as possible in the sliding directions. The recess 94 is provided at its front and back with riding sliding faces 96. The inclination of the sliding faces 96 can be set to an arbitrary angle.

The recess 94 can also be formed deep, as shown in FIG. 7B. FIG. 7B is applied to the case in which the structure has an allowance. A deeper recess 94A than the surfaces of the substrate 13 and the stationary contacts S3 is formed in an insulator portion 39A. At the front and back of the recess 94A, there are formed riding sliding faces 96A. The inclination of these sliding faces 96A can also be set to an arbitrary angle.

The inclination of the sliding faces 91 decides the sharpness in the ON/OFF of the moving contact 63 with respect to the stationary contacts S3 and the operating force of the moving board 5. At a steep inclination of the sliding faces 91, the operating force is high, but the ON/OFF actions of the moving contact 63 on the stationary contacts S3 can be sharply effected. At a gentle inclination of the sliding faces 91, the operating force of the moving board 5 is low, but the sharpness of the ON/OFF of the moving contact 63 with respect to the stationary contacts S3 is relaxed. Therefore, the inclination of the sliding faces 91 is decided considering the operating force of the moving board 5 and the sharpness in the ON/OFF.

Figure 14:
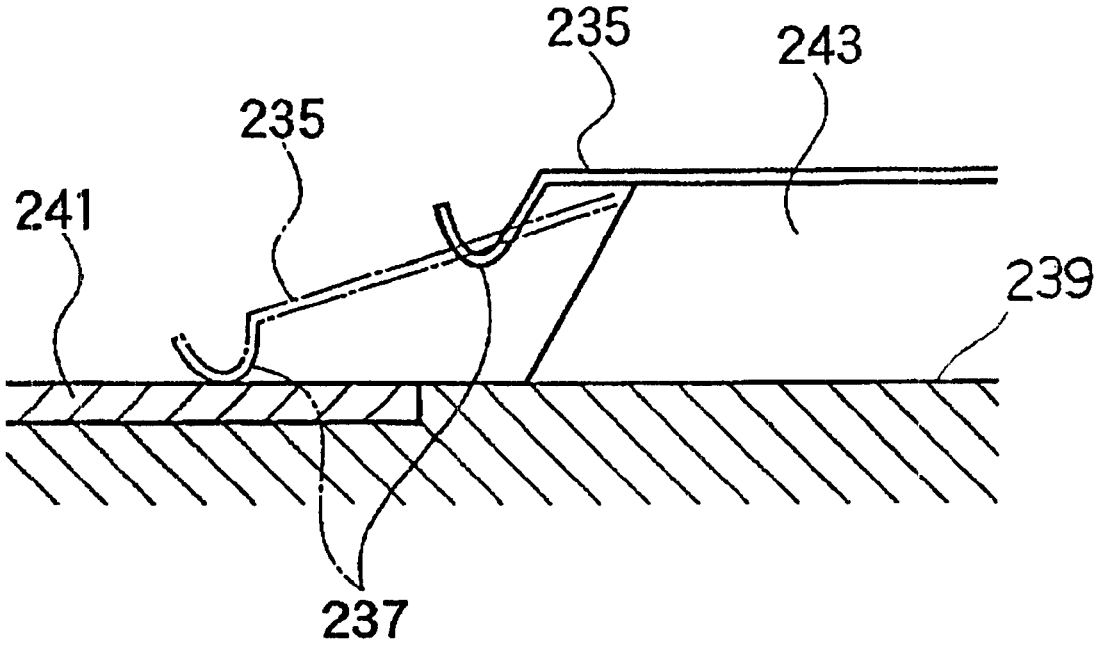
FIG. 14 is a sectional view showing the state, in which the moving contact rides, according to the related art example.
Figure 15:
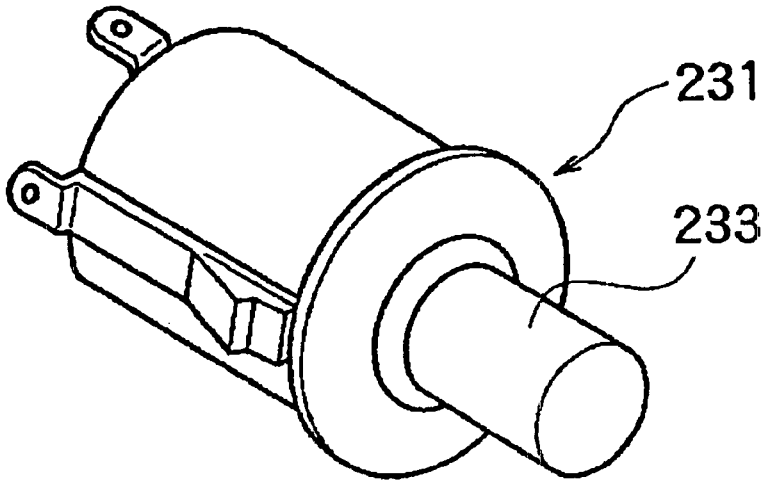
FIG. 15 is a perspective view of a switch according to the related art example.
Figure 16:
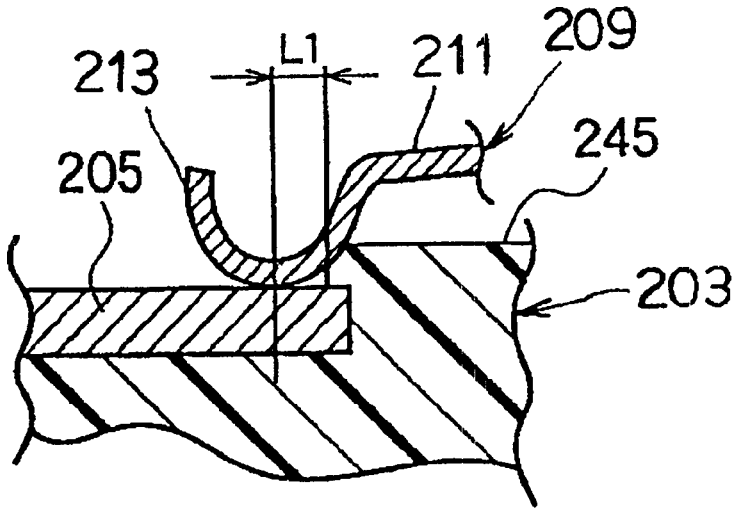
Figure 16:
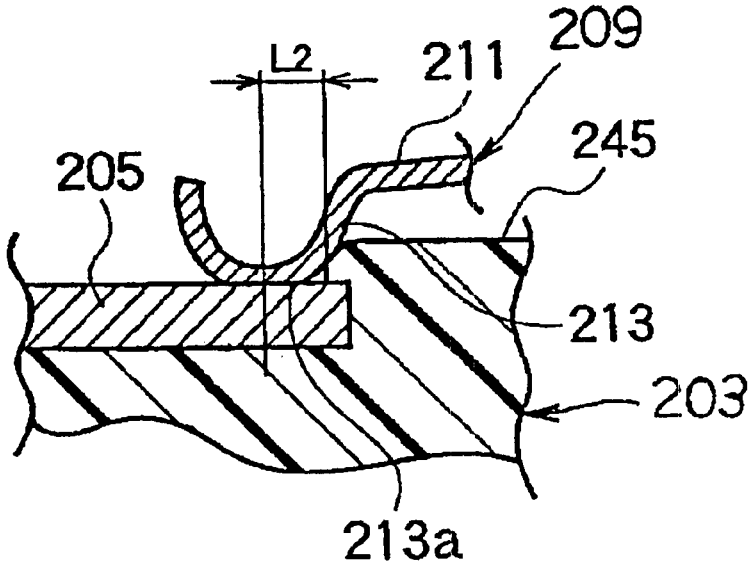

The end portions of the sliding faces 91 are provided with reference faces 97 for the manufacture. With respect to these reference faces 97, the end portions 99 of the stationary contacts S3 go into the lower portions of the insulator portion 39. Therefore, ON/OFF switching positions 95 of the stationary contacts S3 are set with reference to the reference faces 97 so that the end portions 99 of the stationary contacts S3 do not relate to the ON/OFF switching positions 95. Even if sags or burrs are formed at the end portions 99 of the stationary contacts S3, as shown in FIG. 14, therefore, it is possible to set the ON/OFF switching positions 95 accurately.

Thus at the time of setting the ON/OFF switching positions 95 of the stationary contacts S3, what is required for the adjustment is to scrape the mold for the pole board 3 side by the electric discharge machining to decide the reference faces 97. Therefore, the mold for the stationary contacts S3 side need not be adjusted to facilitate the accuracy remarkably. These reference faces 97 provide references for positioning the sliding faces 91 and for setting the inclination. In other words, the reference faces 97 and the sliding faces 91 can be set by electric discharge machining the mold.

Next, when the moving board 5 moves, the contact portion 81 of the contact arm 79 in the moving contact 63 slides with respect to the stationary contact S3. When the contact portion 81 is brought by that slide to the ON/OFF switching position 95 of the stationary contact S3, as shown in FIG. 7A, it abuts against the sliding face 91 and starts to ride and slide on the same. As a result, the contact portion 81 with the stationary contact S3 goes out of contact at the ON/OFF switching position 95.

Next, the contact portion 81 slides on the sliding face 91 and rides and moves on the sliding face 93 parallel to the sliding direction so that it goes over the sliding face 96 into the recess 94. Therefore, the contact portion 81 is positioned in the recess 94 at the OFF circuit time.

However, when the contact portion 81 is brought down the insulator portion 39 from the sliding face 93 over the sliding face 91 by the movement of the moving board 5, the contact portion 81 of the moving contact 63 comes into contact with the stationary contact S3. This contact is ensured at the ON/OFF switching position 95 of the stationary contact S3 by the relation between the contact portion 81 and the sliding face 91.

In the case of the insulator portion 39A of FIG. 7B, like the functions of the insulator portion 39, the contact portion 81 slides over the sliding face 91 and rides and moves over the sliding face 93 parallel to the sliding direction so that it goes over the sliding face 96A into the recess 94A. Therefore, the contact portion 81 is positioned in the recess 94A at the OFF circuit time. Especially in the case of FIG. 7B, a clearance is formed in the recess 94A between the contact portion 81 and the bottom portion 94A*a* of the recess 94A so that the facial pressure on the contact portion 81 can be reduced to zero at the OFF circuit time.

Thus by the actions of the insulator portions 39 and 39A, by the movement of the moving board 5, the contact/non-contact of the contact portion 81 of the moving contact 63 with the stationary contact S3 can be effected not at the end edge of the stationary contact S3 but reliably at the ON/OFF switching position 95 over the stationary contact S3 thereby to make the ON/OFF of the contacts accurate.

After the contact portion 81 rode on the insulator portion 39 or 39A, moreover, it can be brought into the recess 94 or 94A so that the facial pressure of the contact portion 81 can be drastically lowered or reduced to zero at the OFF circuit time. Even when the contact portion 81 slides again, therefore, it can slide under a low or zero facial pressure in the recess 94 or 94A so that the wear of the contact portion 81 can be drastically suppressed. In the case of the inhibitor switch 1 which has no spatial allowance so that the height of the moving contact 63 cannot be changed over the insulator portion 39 or 39A, more specifically, the presence of the recess 94 or 94A can lighten or reduce the facial pressure to zero thereby to suppress the wear of the contact portion 81 remarkably.

Especially when the inhibitor switch 1 is employed in the mission case so that it is splashed with hot oil, the abrasive powder or the like may exist between the contact portion 81 and the insulator portion 39 or 39A to proceed the wear of the contact portion 81 early. By lowering or reducing the facial pressure to zero with the recess 94 or 94A, however, it is possible to suppress the wear of the contact portion 81 reliably.

As a result, the relation between the mechanical position of the moving contact 63 and the contact ON/OFF positions (i.e., the ON/OFF switching positions 95) can be kept long at the initial settings without any offset, thereby to improve the durability of the inhibitor switch 1 drastically.

Moreover, the reduction in the wear at the insulator portion 39 or 39A can suppress production of the abrasion powder. When the contact portion 81 goes down onto the stationary contact S3, no or little abrasion powder of the insulating material is entrained by the contact portion 81 onto the stationary contact S3 so that the contact portion 81 can be prevented from the contact failure when it goes down on the stationary contact S3.

Here in the present embodiment, the contact portion 81 is made to slide on the sliding face 91 or 93 while having its rounded face 80 being in linear contact with the sliding face 91 or 93. Therefore, the contact portion 81 slides not at one portion of the insulator portion 39 or 39A but long over the sliding face 91 or 93 so that the sliding face 91 or 93 can be drastically suppressed in wear. As a result, the sliding face 91 or 93 can keep its shape for a long time, and the ON/OFF switching position 95 of the stationary contact S3 can be kept long and accurate in this respect.

Similar actions are also effected between the stationary contact S2 and the insulator portion 25, and the contact portion 81, between the stationary contact S4 and the insulator portions 27, 29 and 31, and the contact portion 81, and between the stationary contact S1 and the insulator portions 33 and 35, and the contact portion 81. As a result, the inhibitor switch 3 can turn ON/OFF the moving contact 63 and the stationary contacts S2, S4, S1 and S3 accurately as a whole and can keep these accuracies for a long time.

FIG. 8 is a diagram showing the relations between the ON states of the stationary contacts VB, S1, S2, S3 and S4 and the detected states of the shift positions. In this diagram of FIG. 8, circled portions indicate the ON portions. From the ON combinations of the stationary contacts VB, S1, S2, S3 and S4, it is possible to detect the shift positions of the parking range P, the reverse range R, the neutral range N, the drive range D, the third speed 3, the second speed 2 and the first speed 1 accurately.

Here, the recess 94 is provided for lightening the facial pressure (or the contact pressure) of the moving contact 63, as described hereinbefore. The construction could be modified such that the recess 94 is made shallower than that of the aforementioned embodiment so that its bottom portion 94*a* rises from the surfaces of the substrate 13 and the stationary contact S3.

Second Embodiment

Figure 9:
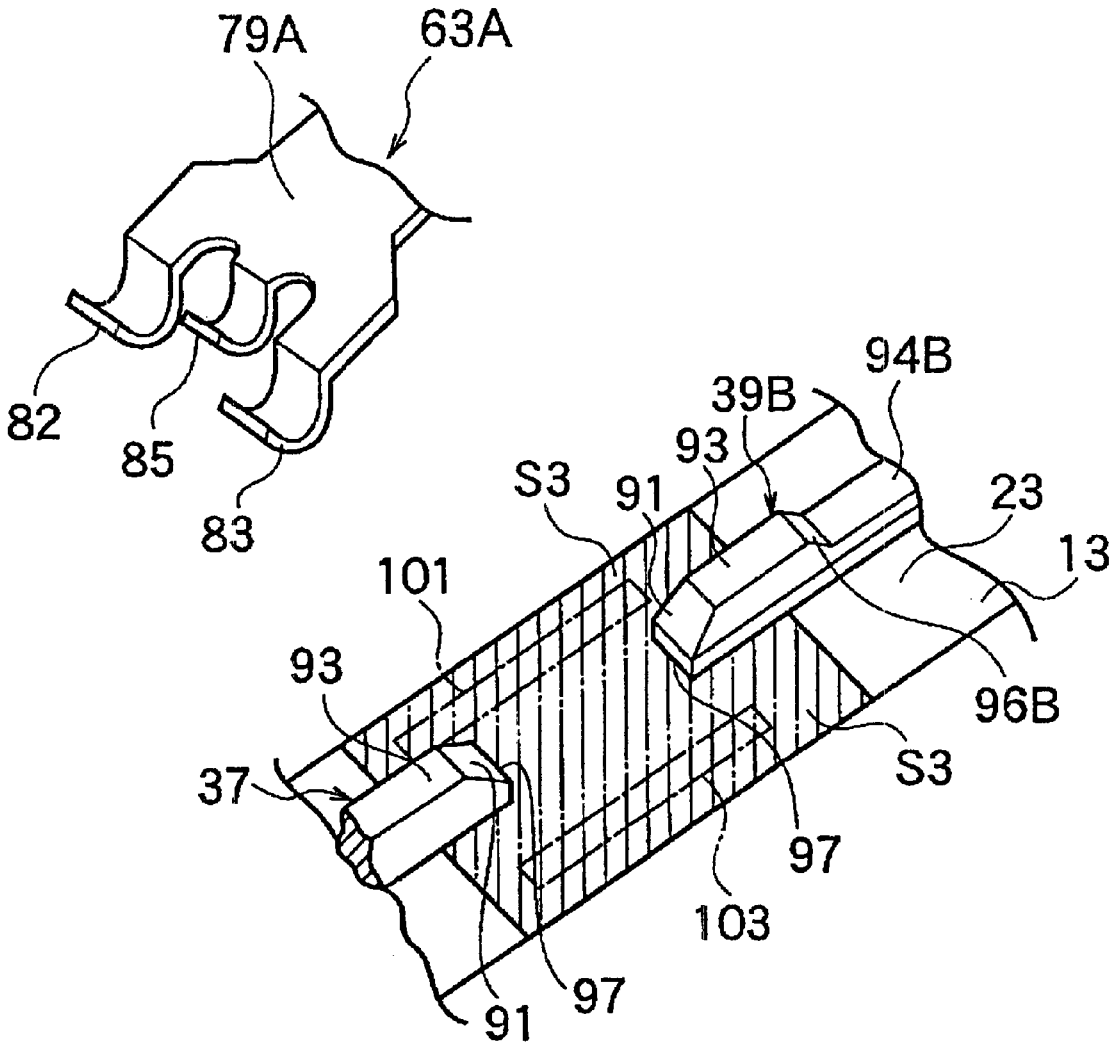
FIG. 9 is a perspective view in an exploded state showing relations among a contact arm, a stationary contact and an insulator portion according to a second embodiment.
Figure 10:
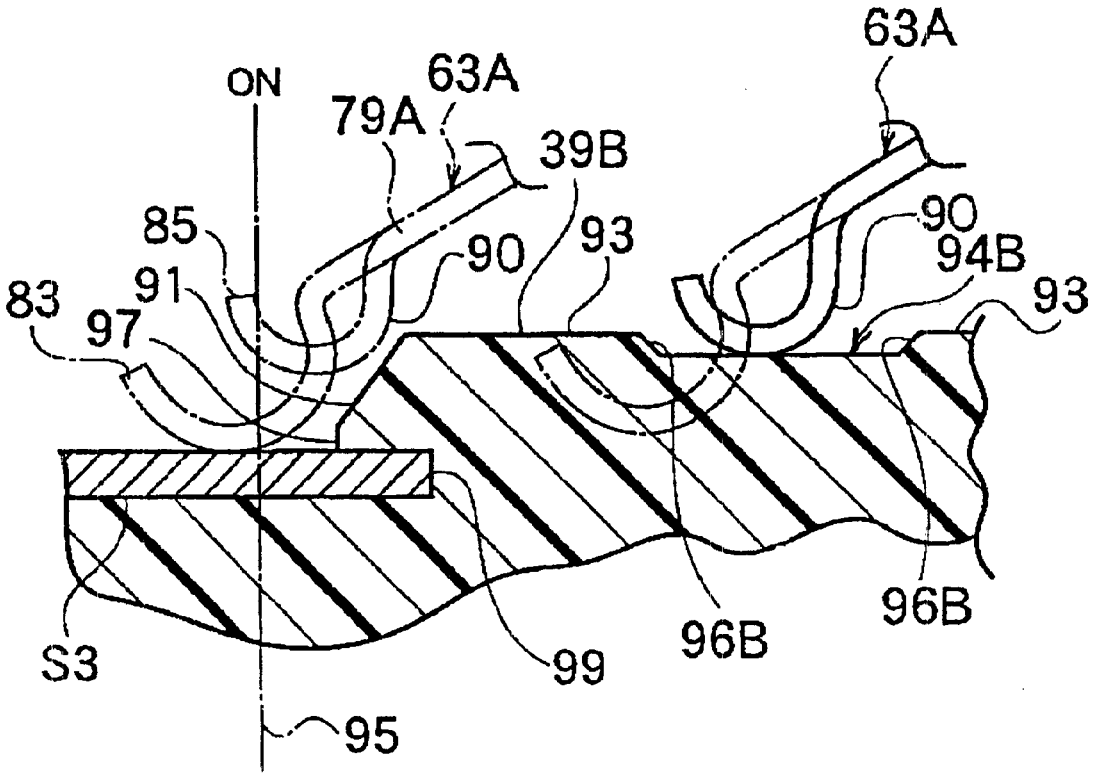
FIG. 10 is an enlarged sectional view showing the periphery of the insulator portion according to the second embodiment.
Figure 11:
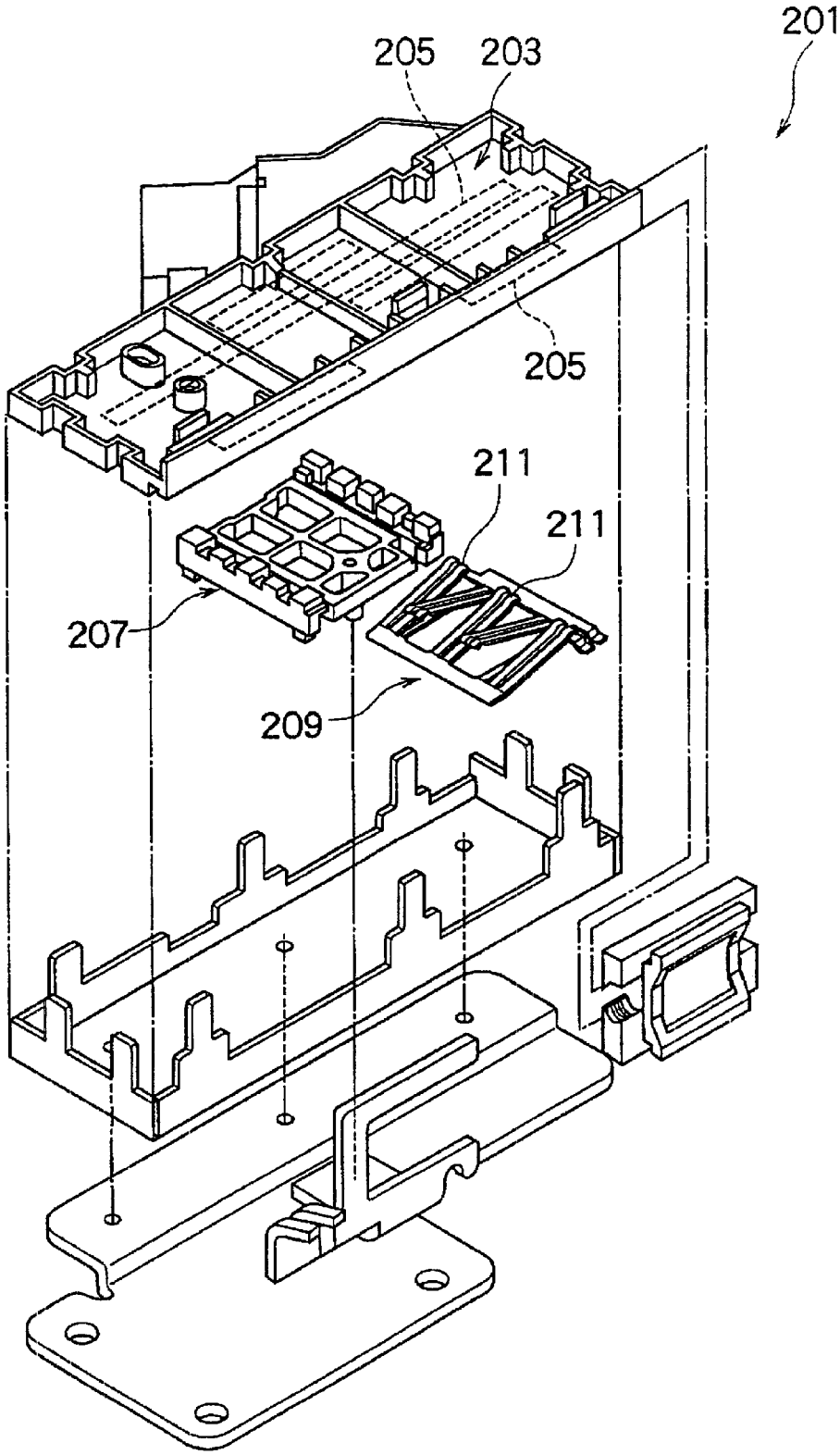
FIG. 11 is an exploded perspective view of an inhibitor switch according to an example of the related art.
Figure 12:
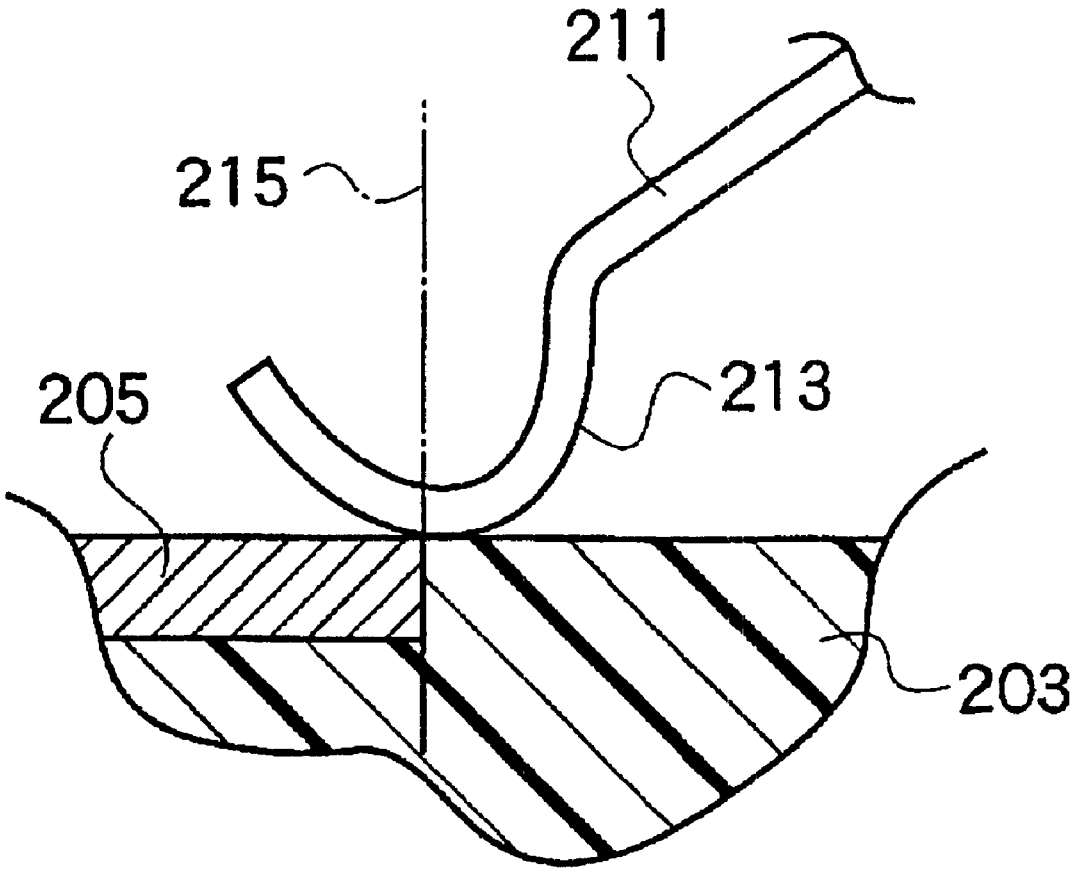
FIG. 12 is a sectional view showing relations between the ON/OFF switching positions of a stationary contact and a moving contact according to the related art example.
Figure 13:
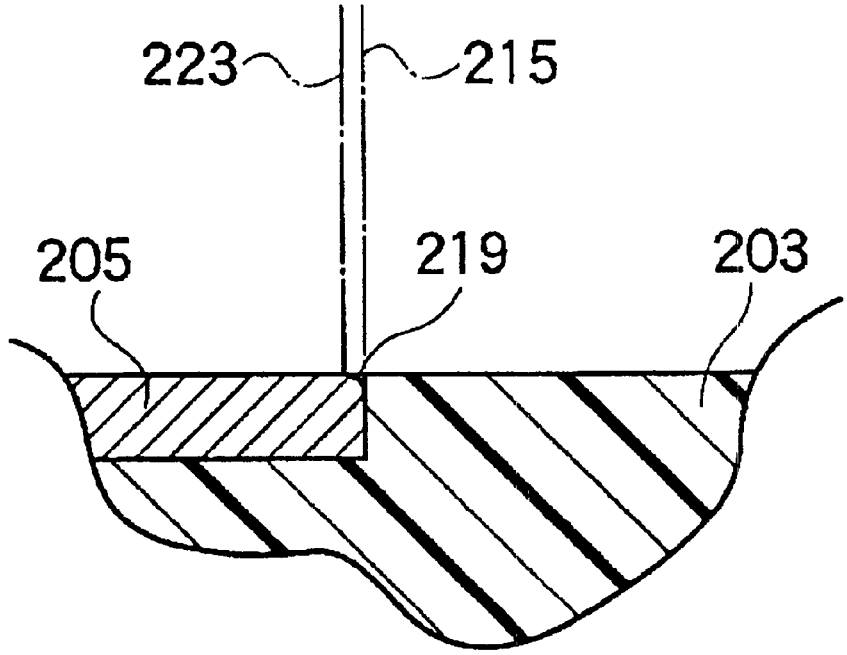
Figure 13:
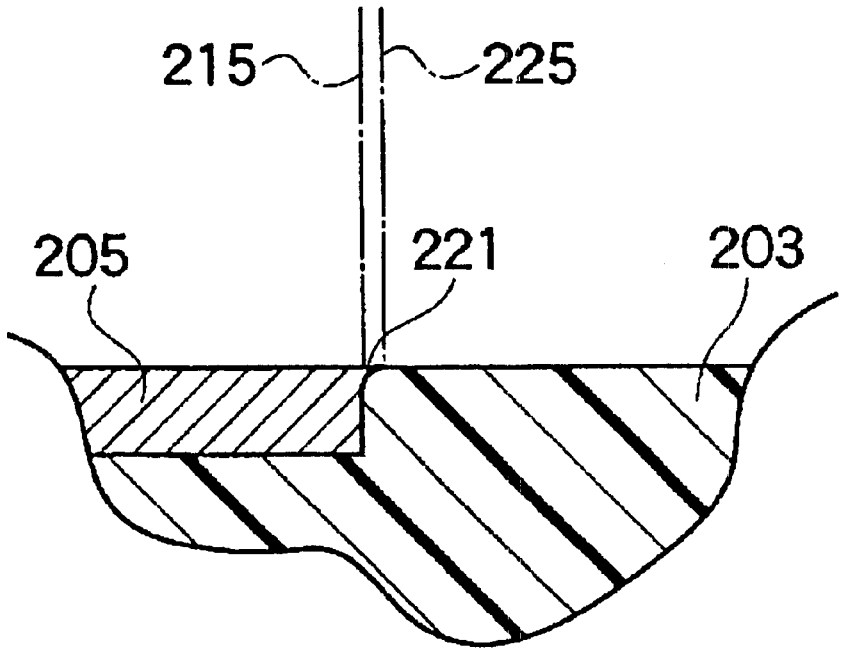

FIG. 9 and FIG. 10 show a second embodiment of the present invention. FIG. 9 is an exploded perspective view showing relations among the stationary contact S3, the insulator portions 37 and 39B, and a contact arm 79A of a moving contact 63A. In this state of FIG. 9, a sectional view of the portions of the stationary contact S3 and the insulator portion 39B is shown in FIG. 10. Here, the constructional portions corresponding to those of the first embodiment will be described by designating them by the common reference numerals. In the present embodiment, too, the relations among the moving contacts, the stationary contacts and the insulator portions are substantially identical at the individual portions, as in the first embodiment. Therefore, the description will be made by extracting the portion of the stationary contact S3, as shown in FIG. 9, while omitting the description of the relations among the remaining stationary contacts, the moving contacts and the insulator portions.

First of all, the contact arm 79A is provided with bifurcated contact portions 82 and 83, as shown in FIG. 9 and FIG. 10. Between the contact portions 82 and 83, there is formed a riding portion 85. This riding portion 83 is made shorter than the individual contact portions 82 and 83 and is formed in a cantilever shape at the contact arm 79A. This riding portion 85 is also curved thereby to form a riding rounded face 90.

The height of the sliding face 93 parallel to the sliding direction from the stationary contact S3 decides the magnitude of the gap between the contact portion 83 and the stationary contact S3 when the moving contact 63A rides on the insulator portion 39B. If the height of the insulator portion 39B from the stationary contact S3 is large, the deflection of the contact arm 79A increases, but the gap between the contact portion 83 and the stationary contact S3 can be enlarged to establish the OFF contact state reliably. Therefore, the height of the sliding face 93 is decided considering the deflection of the contact arm 79A and the gap of the contact portion 83 from the stationary contact S3.

The sliding face 93 is provided with a facial pressure lightening recess 94B corresponding to the OFF position of the moving contact 63. The depth of the recess 94B is made smaller than the distance, as made when the riding portion 85 of the moving contact 63A rides on the sliding face 93 of the insulator portion 39B, between the contact portions 82 and 83 and the surfaces of the stationary contact S3 and the substrate 13. When the riding portion 85 moves into the recess 94B of the insulator portion 39B, therefore, a clearance is formed between the contact portions 82 and 83 and the surface of the substrate 13, as shown in FIG. 10. When the riding portion 85 moves in the recess 94B, therefore, the individual contact portions 82 and 83 do not slide on the surface of the substrate 13 so that the contact portions 82 and 83 can be prevented from wearing out. Moreover, the riding portion 85 can also be prevented from wearing out, because the facial pressure is lowered by the recess 94B. Accordingly, the ON/OFF switching positions of the contact portions 82 and 83 with respect to the stationary contact S3 can be stabilized for a long time to keep their initial set positions. At the front and back of the recess 94B, there are formed riding siding faces 96B. The inclinations of the sliding face 96B can be set at arbitrary angles.

Next, when the moving board 5 moves, the contact portions 82 and 83 of the moving contact arm 79A in the moving contact 63A slide within ranges 101 and 103 of FIG. 9 with respect to the stationary contact S3. When the contact portions 82 and 83 are brought to the ON/OFF switching positions 95 of the stationary contact S3 by the sliding movements of the contact portions 82 and 83 with respect to the stationary contact S3, the rounded face 90 of the riding portion 85 abuts against the sliding face 91 and starts to ride and slide on the same, and the contact portions 82 and 83 go out of contacts at the ON/OFF switching positions 95 from the stationary contact S3.

Next, the riding portion 85 slides on the sliding face 91 and rides and moves on the sliding face 93 parallel to the sliding direction. When the riding portion 85 rides on the sliding face 93, the gap between the contact portions 82 and 83 and the stationary contact S3 takes the set value so that the non-contact state between the contact portions 82 and 83 and the stationary contact S3 can be reliably established.

Next, the contact portion 81 rides and moves on the sliding face 93 parallel to the sliding direction and further moves over the sliding face 96B into the recess 94B. Therefore, the contact portion 81 is positioned in the recess 94B at the OFF circuit time.

When the riding portion 85 is brought down the insulator portion 39B from the sliding face 93 over the sliding face 91 by the movement of the moving board 5, on the contrary, the contact portions 82 and 83 come into contact with the stationary contact S3. This contact is ensured at the ON/OFF switching position 95 over the stationary contact S3 by the relation between the riding portion 85 and the sliding face 91.

In the present embodiment, therefore, the presence of the recess 94B can also attain actions and effects similar to those of the first embodiment.

In the present embodiment, moreover, the riding portion 85 is formed in addition to the contact portions 82 and 83 so that the sliding motions of the contact portions 82 and 83 and the riding portion 85 can be shared between the stationary contact S3 and the insulator portion 39B thereby to make their wears less.

Moreover, there are at least one pair or two cantilever contact portions 82 and 83. Even if a foreign substance should be present between one of the contact portions 82 and 83 and the stationary contact S3 when the contact arm 79A goes down the insulator portion 39B, therefore, the other of the contact portions 82 and 83 could never fail to contact with the stationary contact S3 thereby to keep the contact arm 79A in reliable contact with the stationary contact S3.

Here in the second embodiment, the rounded face 90 is formed by curving the riding portion 85 as a whole, but only the portion to contact with the sliding faces 91 and 93 could also be formed into a rounded portion. Moreover, the riding portion 85 is made separate of the contact portions 82 and 83, but one of the paired contact portions 82 and 83 could also be used as the riding portion without forming the riding portion 85 separately.

The foregoing individual embodiments have been described on the inhibitor switch in which the moving board 5 linearly slides. Despite this description, however, the present invention could naturally be applied to another mechanical structure, for example, not only to an inhibitor switch of this type, in which a rotary arm having a moving contact is provided for a pole having concentrically arranged stationary contacts, but also to another switch.

What is claimed is:

1. A switch having a moving contact made slidable with respect to stationary contacts mounted on a pole board, wherein:

the pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts;

the insulator portions are provided in their sliding faces with recesses which correspond to the OFF positions of the moving contact for reducing facial pressures; and when the moving contact slides with respect to the stationary contacts to the ON/OFF switching positions of the stationary contacts, the moving contact starts to ride on the sliding faces of the insulator portions so that the moving contact goes out of contact with the stationary contacts and can move from the sliding faces into the recesses, and when the moving contact goes down the sliding faces of the insulator portions, the moving contact contacts with the ON/OFF switching positions of the stationary contact.

2. A switch comprising a pole board having stationary contacts; and a moving board including a moving contact made slidable to the stationary contacts and made movable with respect to the pole board, whereby the switch detects the shift position of an automatic transmission with the moving contact and the stationary contacts, wherein:

the pole board is provided with insulator portions of an insulator having sliding faces on their surfaces which are so protruded from the pole board as to correspond to ON/OFF switching positions for providing contact/non-contact boundaries of sliding motions of the moving contact with respect to the stationary contacts;

the insulator portions are provided in their sliding faces with recesses which correspond to the OFF positions of the moving contact for reducing facial pressures; and when the moving contact slides with respect to the stationary contacts to the ON/OFF switching positions of the stationary contacts, the moving contact starts to ride on the sliding faces of the insulator portions so that the moving contact goes out of contact with the stationary contacts and can move from the sliding faces into the recesses, and when the moving contact goes down the sliding faces of the insulator portions, the moving contact contacts with the ON/OFF switching positions of the stationary contact.

3. A switch as according to claim 1 or 2, wherein the recesses have a depth set equal to or more than the distance between the sliding faces of the insulator portions and the surfaces of the stationary contacts.

4. A switch according to claim 1 or 2, wherein the moving contact is provided with a contact portion for contacting with the stationary contacts and a riding portion capable of riding on the insulator portions; and when the contact portion slides with respect to the stationary contacts to the ON/OFF switching positions of the stationary contacts, the riding portion starts to ride on the sliding faces of the insulator portions so that the contact portion goes out of contact with the stationary contacts and so that the riding portion can move from the sliding faces into the recesses, and when the riding portion goes down the sliding faces of the insulator portions, the contact portion contacts with the ON/OFF switching positions of the stationary contact.

5. A switch according to claim 4, wherein the recess has a depth smaller than the distance, as formed when the riding portion rides on the sliding faces of the insulator portions, between the contact portion and the stationary contacts.

* * * * *